US007465700B1

(12) United States Patent
Ochomogo et al.

(10) Patent No.: US 7,465,700 B1
(45) Date of Patent: Dec. 16, 2008

(54) NATURAL CLEANING COMPOSITIONS

(75) Inventors: Maria Ochomogo, Danville, CA (US); Aram Garabedian, Fremont, CA (US); Ryan K. Hood, Dublin, CA (US); Thomas W. Kaaret, Alamo, CA (US); Laura Shimmin, Oakland, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 12/136,934

(22) Filed: Jun. 11, 2008

Related U.S. Application Data

(63) Continuation-in-part of application No. 11/765,516, filed on Jun. 20, 2007, now Pat. No. 7,396,808.

(51) Int. Cl.
*C11D 3/20* (2006.01)
*C11D 3/22* (2006.01)
*C11D 3/43* (2006.01)
*C11D 3/50* (2006.01)

(52) U.S. Cl. ..... 510/474; 510/101; 510/191; 510/199; 510/235; 510/238; 510/239; 510/240; 510/432; 510/460; 510/466; 510/470

(58) Field of Classification Search ..... 510/101, 510/191, 199, 235, 238, 239, 240, 432, 460, 510/466, 470, 474
See application file for complete search history.

(56) References Cited

U.S. PATENT DOCUMENTS

| | | | | |
|---|---|---|---|---|
| 4,753,844 | A | 6/1988 | Jones | |
| 5,025,069 | A | 6/1991 | Deguchi et al. | |
| 5,342,534 | A | 8/1994 | Skrobala | |
| 6,121,228 | A * | 9/2000 | Drapier et al. | 510/417 |
| 6,302,969 | B2 | 10/2001 | Moster et al. | |
| 6,420,326 | B1 | 7/2002 | Maile et al. | |
| 6,831,050 | B2 | 12/2004 | Murch et al. | |
| 7,082,951 | B2 | 8/2006 | Barnabas et al. | |
| 7,182,950 | B2 | 2/2007 | Garti et al. | |
| 7,396,808 | B1 * | 7/2008 | Hood et al. | 510/474 |
| 2005/0282720 | A1 | 12/2005 | Itoh et al. | |

FOREIGN PATENT DOCUMENTS

| | | |
|---|---|---|
| WO | WO2005/091981 | 10/2005 |

* cited by examiner

*Primary Examiner*—Brian P Mruk
(74) *Attorney, Agent, or Firm*—Alok Goel; David Peterson

(57) ABSTRACT

A cleaning composition with a limited number of natural ingredients contains alkyl polyglucoside, ethanol and colloidal silica. The cleaning composition optionally has a small amount of glycerol. The cleaning composition optionally has a small amount of fragrance. The cleaning composition can be used to clean hard surfaces and cleans as well or better than commercial compositions containing synthetically derived cleaning agents.

20 Claims, No Drawings

NATURAL CLEANING COMPOSITIONS

CROSS-REFERENCES TO RELATED APPLICATION

This application is a continuation-in-part of application of U.S. Ser. No. 11/765,516, filed on Jun. 20, 2007, now U.S. Pat. No. 7,396,808, which is incorporated herein by reference.

BACKGROUND OF THE INVENTION

1. Field of the Invention

The present invention relates generally to cleaning compositions for use on hard surfaces. In one embodiment, the present invention relates to cleaning compositions for use on glass surfaces. The invention also relates to cleaning compositions for use with cleaning substrates, cleaning heads, cleaning pads, cleaning sponges and related systems for cleaning hard surfaces. The composition also relates to natural cleaning compositions having a limited number of ingredients and having good cleaning properties and low residue.

2. Description of the Related Art

Cleaning formulations have progressed and created a large chemical industry devoted to developing new synthetic surfactants and solvents to achieve ever improving cleaning compositions for the consumer. Because of a desire to use renewable resources, natural based cleaners are gaining increasing interest. Most of these cleaners contain only some natural ingredients. One difficulty in formulating natural based cleaners is achieving acceptable consumer performance with a limited number of natural components compared to highly developed formulations using synthetic surfactants and solvents.

Typical cleaning formulations require multiple surfactants, solvents, and builder combinations to achieve adequate consumer performance. For example, U.S. Pat. No. 5,025,069 to Deguchi et al. discloses alkyl glycoside detergent systems with anionic, amphoteric and nonionic surfactant ingredients. U.S. Pat. No. 7,182,950 to Garti et al. discloses nano-sized concentrates with examples using Tween® surfactants. U.S. Pat. No. 6,831,050 to Murch et al. discloses toxicologically acceptable cleaners containing oleic acid and citric acid. U.S. Pat. No. 6,302,969 to Moster et al. discloses natural cleaners containing anionic surfactants. U.S. Pat. No. 6,420,326 to Maile et al. discloses glass cleaners with ethanol, glycol ethers, and anionic surfactants.

Prior art compositions do not combine effective cleaning with a minimum number of ingredients, especially with natural ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises a hard surface cleaning composition consisting essentially of 0.1 to 5% alkyl polyglucoside; 0.5 to 5% ethanol; 0.1 to 3% colloidal silica; water; and optionally dyes, builders, fragrances, fatty acids, colorants, and preservatives.

In accordance with the above objects and those that will be mentioned and will become apparent below, another aspect of the present invention comprises a hard surface cleaning composition consisting essentially of 0.1 to 5% alkyl polyglucoside; 0.5 to 5% ethanol; 0.05 to 5% glycerol; 0.1 to 3% colloidal silica; water; and optionally dyes, builders, fatty acids, fragrances, colorants and preservatives.

In accordance with the above objects and those that will be mentioned and will become apparent below, another aspect of the present invention comprises a hard surface cleaning composition consisting essentially of 0.1 to 5% alkyl polyglucoside; 0.5 to 5% ethanol; 0.01 to 1% fragrance; 0.1 to 3% colloidal silica; water; and optionally dyes, builders, fatty acids, colorants and preservatives.

In accordance with the above objects and those that will be mentioned and will become apparent below, another aspect of the present invention comprises a hard surface cleaning composition consisting essentially of 0.1 to 5% alkyl polyglucoside; 0.5 to 5% ethanol; 0.05 to 5% glycerol; 0.01 to 1% fragrance; 0.1 to 3% colloidal silica; water; and optionally dyes, fatty acids, builders, colorants and preservatives.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes, but is not limited to, anionic, nonionic and/or amphoteric agents.

The term "consisting essentially of" as used herein, limits the scope of a claim to the specified materials or steps "and those that do not materially affect the basic and novel characteristic(s)" of the claimed invention. In re Herz, 537 F.2d 549, 551-52, 190 USPQ 461, 463 (CCPA 1976) (emphasis in original). See MPEP 2111.03 For the purposes of searching for and applying prior art under 35 U.S.C. 102 and 103, absent a clear indication in the specification or claims of what the basic and novel characteristics actually are, "consisting essentially of" will be construed as equivalent to "comprising." See, e.g., PPG, 156 F.3d at 1355, 48 USPQ2d at 1355. See MPEP 2111.03

Alkyl Polyglucoside

The cleaning compositions may contain alkyl polyglucoside ("APG") surfactant. The cleaning compositions preferably have an absence of other nonionic surfactants, especially synthetic nonionic surfactants, such as ethoxylates. The cleaning compositions preferably have an absence of other surfactants, such as anionic, cationic, and amphoteric surfactants. Suitable alkyl polyglucoside surfactants are the alkylpolysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside, hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylpolyglycosides (or alkylpolyglucosides) have the formula: $R^2O(C_nH_{2n}O)_t(\text{glucosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is about 2 or about 3, preferably about 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantely the 2-position.

A group of alkyl glycoside surfactants suitable for use in the practice of this invention may be represented by formula I below:

$$RO—(R^2O)_y—(G)_xZ_b \qquad \text{I}$$

wherein R is a monovalent organic radical containing from about 6 to about 30 (preferably from about 8 to about 18) carbon atoms; $R^2$ is a divalent hydrocarbon radical containing from about 2 to about 4 carbon atoms; 0 is an oxygen atom; y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2); Z is $O_2M^1$, $O_2CR^3$, $O(CH_2)$, $CO_2M^1$, $OSO_3M^1$, or $O(CH_2)SO_3M^1$; $R^3$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $—CO_2M^1$ group); b is a number from 0 to 3x+1 preferably an average of from 0.5 to 2 per glycosal group; p is 1 to 10, $M^1$ is $H^+$ or an organic or inorganic cation, such as, for example, an alkali metal, ammonium, monoethanolamine, or calcium. As defined in Formula I, R is generally the residue of a fatty alcohol having from about 8 to 30 or 8 to 18 carbon atoms. Suitable alkylglycosides include, for example, APG 325® (a $C_9$-$C_{11}$ alkyl polyglycoside available from Cognis Corporation), APG 625® (a $C_{10}$-$C_{16}$ alkyl polyglycoside available from Cognis Corporation), Dow Triton® CG110 (a $C_8$-$C_{10}$ alkyl polyglycoside available from Dow Chemical Company), AG6202® (a $C_8$ alkyl polyglycoside available from Akzo Nobel) and Alkadet 15® (a $C_8$-$C_{10}$ alkyl polyglycoside available from Huntsman Corporation). A $C_8$ to $C_{10}$ alkylpoly-glucoside includes alkylpolyglucosides wherein the alkyl group is substantially C8 alkyl, substantially C10 alkyl, or a mixture of substantially C8 and C10 alkyl. Suitably, the alkyl polyglycoside is present in the cleaning composition in an amount ranging from about 0.01 to about 5 weight percent, or 0.1 to 5.0 weight percent, or 0.5 to 5 weight percent, or 0.5 to 4 weight percent, or 0.5 to 3 weight percent, or 0.5 to 2.0 weight percent, or 0.1 to 0.5 weight percent, or 0.1 to 1.0 weight percent, or 0.1 to 2.0 weight percent, or 0.1 to 3.0 weight percent, or 0.1 to 4.0 weight percent.

Ethanol

The cleaning compositions may contain the organic solvent ethanol, either absolute, various dilutions with water or denatured alcohol, for example denatured with isopropanol. Natural forms of ethanol can be derived from the fermentation of biomass or the hydrolysis of cellulose. Synthetic ethanol can be derived from the catalytic hydration of ethylene. The compositions suitably do not contain additional solvents, especially synthetic solvents such as glycol ethers. Suitably, the ethanol is present in the cleaning composition in an amount ranging from about 0.01 to about 5 weight percent, or 0.1 to 5.0 weight percent, or 0.1 to 4.0 weight percent, or 0.1 to 3.0 weight percent, or 0.1 to 2.0 weight percent, or 0.1 to 1.0 weight percent, or 0.5 to 5.0 weight percent, or 0.5 to 4.0 weight percent, or 0.5 to 3.0 weight percent, or 0.5 to 2.0 weight percent, or 0.5 to 1.0 weight percent.

Glycerol

The cleaning compositions may contain glycerol, or glycerin. The glycerol may be natural, for example from the saponification of fats in soap manufacture, or synthetic, for example by the oxidation and hydrolysis of allyl alcohol. The glycerol may be crude or highly purified. The glycerol can serve to compatibilize the alkyl polyglucoside, the ethanol and the fragrance (i.e., lemon oil or d-limonene). Proper compatibilization of these components in suitable ratios, such as demonstrated in the examples below, allow these limited components to perform as well as complex formulated conventional synthetic cleaning compositions. Glycerol is an effective way of solubilizing the fragrance at the lower surfactant levels without increasing filming or streaking. Suitably, the glycerol is present in the cleaning composition in an amount ranging from about 0.01 to about 2 weight percent, or 0.05 to 2.0 weight percent, or 0.05 to 1.0 weight percent, or 0.05 to 0.5 weight percent, or 0.05 to 1.0 weight percent, or 0.10 to 2.0 weight percent, or 0.10 to 1.0 weight percent, or 0.10 to 0.5 weight percent.

The Nano-Particle Silica Dispersion

The cleaning compositions may contain nanoparticles of collidal silica. Nanoparticles, defined as particles with diameters of about 400 nm or less, are technologically significant, since they have novel and useful properties due to the very small dimensions of their particulate constituents. "Non-photoactive" nanoparticles do not use UV or visible light to produce the desired effects. Nanoparticles can have many different particle shapes. Shapes of nanoparticles can include, but are not limited to spherical, parallelepiped-shaped, tube shaped, and disc or plate shaped. Suitably, the colloidal silica is present in the cleaning composition in an amount ranging from about 0.1 to about 3 weight percent, or about 0.1 to about 2.5 weight percent, or about 0.1 to about 2.0 weight percent, or about 0.1 to about 1.5 weight percent, or about 0.1 to about 1.4 weight percent, or about 0.1 to about 1.3 weight percent, or about 0.1 to about 1.2 weight percent, or about 0.1 to about 1.1 weight percent, or about 0.1 to about 1.0 weight percent, or about 0.1 to about 0.8 weight percent, or about 0.1 to about 0.5 weight percent, or about 0.2 to about 1.0 weight percent, about 0.2 to about 0.8 weight percent.

Nanoparticles with particle sizes ranging from about 1 nm to about 400 nm can be economically produced. Particle size distributions of the nanoparticles may fall anywhere within the range from about 1 nm, or less, to less than about 400 nm, alternatively from about 2 nm to less than about 300 nm, alternatively from about 5 nm to less than about 150 nm, alternatively 1 nm to 100 nm, alternatively 5 nm and 50 nm, alternatively 1 nm and 25 nm, and alternatively 1 nm and 10 nm. Preferred ranges of the colloidal silica further include, but are not limited to, less than 400 nm, less than 350 nm, less than 300 nm, less than 250 nm, less than 200 nm, less than 175 nm, less than 150 nm, less than 125 nm, less than 100 nm, less than 90 nm, less than 80 nm, less than 75 nm, less than 70 nm, less than 60 nm, less than 50 nm, less than 40 nm, less than 30 nm, less than 25 nm, less than 20 nm, less than 10 nm, less than 9 nm, less than 8 nm, less than 7 nm, less than 6 nm, less than 5 nm, less than 4 nm, less than 3 nm, less than 2 nm and less than 1 nm. Commercial colloidal silica suspensions having a primary particle size between 5 to 150 nanometer (nm) and a surface area between 50-800 m.sup.2/g are suitable for use in the present invention. The surface area is generally measured by BET (see DIN 66131; originally described in JACS, Vol. 60, 1938, p. 309 by Brunauer, et al. Colloidal suspensions are generally preferred for ease of handling in preparing the inventive compositions, but these may also be prepared using any available source of colloidal silica according to methods known in the art.

The source of colloidal silica may be selected from silica dioxide, silicon dioxide, crystalline silica, quartz, amorphous fumed silica, food grade silica, flint, hydrophobic fumed silica, treated fumed silica, untreated fumed silica, amorphous fused silica, precipitated amorphous silica, microcrystalline silica, foundry sand, utility sand, fracturing sand, silica sand, silica, flint, glass sand, melting sand, engine sand, blasting sand, traction sand, hydraulic fracturing sands, filter sand, soft silica, condensed silica fume, cristobalite, tridymite, synthetic fused silica, hydrated precipitated silica, colloidal silica, silica dispersion, and silica aerogels. Further, silicas may be selected from the general categories of silicone dioxide (SiO.sub.2) described as aerogel, amorphous, colloidal, crystalline, diatomaceous, food grade, fumed, fused, hydrophilic, hydrophobic, novaculite, precipitated, quartz and/or synthetic silica. Amorphous (CAS #7631-86-9), crystalline (CAS # 14808-60-7), and/or mixed type colloidal silica particles may be employed. Generally, amorphous silica forms are preferably employed for applications in which their improved safety characteristics are desirable. Also suitable is amorphous fumed silica, crystalline-free (CAS # 112945-52-5), amorphous hydrated silica and synthetic amorphous silica gel (SiO.sub.2×$H_2O$, x=degree of hydration, CAS # 63231-67-4), precipitated silica gel, crystalline-free (CAS # 112926-00-8), amorphous, precipitated silica gel (CAS #7699-41-4), silica hydrate (CAS #10279-57-9), vitreous silica (CAS # 60676-86-0) and crystalline-free silicon dioxide (CAS #7631-86-9).

Suitable amorphous silicas commercially available in the preferred colloidal nanometer size domain include Ludox (available from Dupont), Klebosol (available from Clariant), Bindzil, Nyacol (both available from Akzo Nobel), Levasil (available from Bayer), Koestrosol (available from CWK), and Snowtex (available from Nissan Chemicals). For example, two varying sized colloidal silica products were evaluated, Bindzil 30/360FG (12 nm), 0.075 ppm and Klebosol 35 V 50 (70 nm), 0.10 ppm.

In one embodiment, the surface of the colloidal silica may be modified. Examples of colloidal silica (modified or unmodified) include, but are not limited to, Bindzil® 215 (anionic surface), Bindizil® 15/500 (anionic surface), Bindizil® 30/360 (anionic surface), Bindizil® 830 (anionic surface), Bindizil® 2034 DI (anionic, acid surface), Bindizil® 9950 (anionic surface), Bindizil® 50/80 (anionic surface), Bindizil® DP5110 (aluminum modified surface), Bindizil® 25AT/360 (aluminum modified surface), Bindizil® CAT80 (cationic surface) and Bindizil® CC30 (silane treated surface).

Fragrances

The cleaning compositions may contain natural essential oils or fragrances. The natural essential oils or fragrances may include lemon oil or d-limonine, a citrus-based fragrance or a vinegar-like fragrance or mixtures thereof. Lemon oil or d-limonene helps the performance characteristics of the cleaning composition to allow suitable consumer performance with natural ingredients and a minimum of ingredients. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, fragrances are present in the cleaning composition in an amount ranging from about 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 0.40 weight percent, or 0.05 to 0.30 weight percent, or 0.05 to 0.25 weight percent, or 0.05 to 0.20 weight percent, or 0.05 to 0.10 weight percent.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen. Each of these botanical oils is commercially available.

Builders

The cleaning compositions may contain less than 0.2% builder, or no builder. Suitably, the builder is present in the cleaning composition in an amount ranging from about 0.01 to about 0.2 weight percent, or 0.01 to less than 0.2 weight percent, or 0.01 to 0.15 weight percent, or 0.01 to 0.10 weight percent, or 0.01 to 0.05 weight percent. The builder can be selected from inorganic builders, such as alkali metal carbonate, alkali metal bicarbonate, alkali metal hydroxide, alkali metal silicate and combinations thereof. These builders are often obtained from natural sources.

The cleaning composition can include a builder, which increases the effectiveness of the surfactant. The builder can also function as a softener, a sequestering agent, a buffering agent, or a pH adjusting agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxy-sulfonates, and starch derivatives. Builders, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl)amino methane (TRIS),2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, and acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide. The term silicate is meant to encompass silicate, metasilicate, polysilicate, aluminosilicate and similar compounds.

Fatty Acids

The cleaning composition can optionally contain fatty acids. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, arachidonic acid, eicosapentaenoic acid, erucic acid, docosahexaenoic acid or mixtures thereof. Suitably, fatty acids are present in the cleaning composition in an amount ranging from about 0.01 to about 1.0 weight percent, 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 0.40 weight percent, or 0.05 to 0.30 weight percent, or 0.04 to 0.25 weight percent, or 0.04 to 0.20 weight percent, or 0.04 to 0.10 weight percent.

Dyes, Colorants, and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene.

Water

When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

pH

The pH of the cleaning composition is measured directly without dilution. The cleaning compositions using a standard anionic colloidal silica can have a pH of 7 or above, or 7.5 or above, or 8 or above, or 9 or above, or 10 or above, or from 7.5 to 11, or from 8 to 11, or from 9 to 11. The cleaning compositions using a standard anionic colloidal silica can also have a pH of 4 or below, 3 or below, 2 or below, 1 or below, or from 1 to 4, or from 2 to 4, or from 1 to 3 or from 0.5 to 3.5 or from 0.5 to 3.

The pH of the cleaning composition can be acidic or basic if the present invention uses surface modified anionic colloidal silica. If a modified anionic colloidal silica is used, the cleaning compositions can have a pH of 11 or below, 10 or below, 9 or below, 8 or below, 7 or below, 6 or below, or from 5 or below, or from 4 or below, or from 2 to 11, or from 3 to 10, or from 4 to 9, or from 5 to 8, or from 2 to 7.

If a cationic colloidal silica is used, the cleaning compositions can have a pH of 6 or below, or 5 or below, or 4 or below, or 3 or below, or 2 or below, or from 1 to 6, or from 2 to 5, or from 1 to 4, or from 2 to 4.

Substances Generally Recognized as Safe

Compositions according to the invention may comprise substances generally recognized as safe (GRAS), including essential oils, oleoresins (solvent-free) and natural extractives (including distillates), and synthetic flavoring materials and adjuvants. Compositions may also comprise GRAS materials commonly found in cotton, cotton textiles, paper and paperboard stock dry food packaging materials (referred herein as substrates) that have been found to migrate to dry food and, by inference may migrate into the inventive compositions when these packaging materials are used as substrates for the inventive compositions.

Suitable GRAS materials are listed in the Code of Federal Regulations (CFR) Title 21 of the United States Food and Drug Administration, Department of Health and Human Services, Parts 180.20, 180.40 and 180.50, which are hereby incorporated by reference. These suitable GRAS materials include essential oils, oleoresins (solvent-free), and natural extractives (including distillates). The GRAS materials may be present in the compositions in amounts of up to about 10% by weight, preferably in amounts of 0.01 and 5% by weight.

Preferred GRAS materials include oils and oleoresins (solvent-free) and natural extractives (including distillates) derived from alfalfa, allspice, almond bitter (free from prussic acid), ambergris, ambrette seed, angelica, angostura (cusparia bark), anise, apricot kernel (persic oil), asafetida, balm (lemon balm), balsam (of Peru), basil, bay leave, bay (myrcia oil), bergamot (bergamot orange), bois de rose (Aniba rosaeodora Ducke), cacao, camomile (chamomile) flowers, cananga, *capsicum*, caraway, cardamom seed (cardamon), carob bean, carrot, cascarilla bark, *cassia* bark, Castoreum, celery seed, cheery (wild bark), chervil, cinnamon bark, Civet (zibeth, zibet, zibetum), ceylon (*Cinnamomum zeylanicum* Nees), cinnamon (bark and leaf), citronella, citrus peels, clary (clary sage), clover, coca (decocainized), coffee, cognac oil (white and green), cola nut (kola nut), coriander, cumin (cummin), curacao orange peel, cusparia bark, dandelion, dog grass (quackgrass, triticum), elder flowers, estragole (esdragol, esdragon, estragon, tarragon), fennel (sweet), fenugreek, galanga (galangal), geranium, ginger, grapefruit, guava, hickory bark, horehound (hoarhound), hops, horsemint, hyssop, immortelle (*Helichrysum augustifolium* DC), jasmine, juniper (berries), laurel berry and leaf, lavender, lemon, lemon grass, lemon peel, lime, linden flowers, locust bean, lupulin, mace, mandarin (Citrus reticulata Blanco), marjoram, mate, menthol (including menthyl acetate), molasses (extract), musk (Tonquin musk), mustard, naringin, neroli (bigarade), nutmeg, onion, orange (bitter, flowers, leaf, flowers, peel), origanum, palmarosa, paprika, parsley, peach kernel (persic oil, pepper (black, white), peanut (stearine), peppermint, Peruvian balsam, petitgrain lemon, petitgrain mandarin (or tangerine), pimenta, pimenta leaf, pipsissewa leaves, pomegranate, prickly ash bark, quince seed, rose (absolute, attar, buds, flowers, fruit, hip, leaf), rose geranium, rosemary, safron, sage, St. John's bread, savory, *schinus molle* (*Schinus molle* L), sloe berriers, spearmint, spike lavender, tamarind, tangerine, tarragon, tea (*Thea sinensis* L.), thyme, tuberose, turmeric, vanilla, violet (flowers, leaves), wild cherry bark, ylang-ylang and zedoary bark.

Suitable synthetic flavoring substances and adjuvants are listed in the Code of Federal Regulations (CFR) Title 21 of the United States Food and Drug Administration, Department of Health and Human Services, Part 180.60, which is hereby incorporated by reference. These GRAS materials may be present in the compositions in amounts of up to about 1% by weight, preferably in amounts of 0.01 and 0.5% by weight.

Suitable synthetic flavoring substances and adjuvants that are generally recognized as safe for their intended use, include acetaldehyde (ethanal), acetoin (acetyl methylcarbinol), anethole (parapropenyl anisole), benzaldehyde (benzoic aldehyde), n-Butyric acid (butanoic acid), d- or l-carvone (carvol), cinnamaldehyde (cinnamic aldehyde), citral (2,6-dimethyloctadien-2,6-al-8, gera-nial, neral), decanal (N-decylaldehyde, capraldehyde, capric aldehyde, caprinaldehyde, aldehyde C-10), ethyl acetate, ethyl butyrate, 3-Methyl-3-phenyl glycidic acid ethyl ester (ethyl-methyl-phenyl-glycidate, so-called strawberry aldehyde, C-16 aldehyde), ethyl vanillin, geraniol (3,7-dimethyl-2,6 and 3,6-octadien-1-ol), geranyl acetate (geraniol acetate), limonene (d-, l-, and dl-), linalool (linalol, 3,7-dimethyl-1,6-octadien-3-ol), linalyl acetate (bergamol), methyl anthranilate (methyl-2-aminobenzoate), piperonal (3,4-methylenedioxy-benzaldehyde, heliotropin) and vanillin.

Suitable GRAS substances that may be present in the inventive compositions that have been identified as possibly migrating to food from cotton, cotton textiles, paper and paperboard materials used in dry food packaging materials are listed in the Code of Federal Regulations (CFR) Title 21 of the United States Food and Drug Administration, Department of Health and Human Services, Parts 180.70 and 180.90, which are hereby incorporated by reference. The GRAS materials may be present in the compositions either by addition or incidentally owing to migration from the substrates to the compositions employed in the invention, or present owing to both mechanisms. If present, the GRAS materials may be present in the compositions in amounts of up to about 1% by weight.

Suitable GRAS materials that are suitable for use in the invention, identified as originating from either cotton or cotton textile materials used as substrates in the invention, include beef tallow, carboxymethylcellulose, coconut oil (refined), cornstarch, gelatin, lard, lard oil, oleic acid, peanut oil, potato starch, sodium acetate, sodium chloride, sodium silicate, sodium tripolyphosphate, soybean oil (hydrogenated), talc, tallow (hydrogenated), tallow flakes, tapioca starch, tetrasodium pyrophosphate, wheat starch and zinc chloride.

Suitable GRAS materials that are suitable for use in the invention, identified as originating from either paper or paperboard stock materials used as substrates in the invention, include alum (double sulfate of aluminum and ammonium potassium, or sodium), aluminum hydroxide, aluminum oleate, aluminum palmitate, casein, cellulose acetate, cornstarch, diatomaceous earth filler, ethyl cellulose, ethyl vanillin, glycerin, oleic acid, potassium sorbate, silicon dioxides, sodium aluminate, sodium chloride, sodium hexametaphosphate, sodium hydrosulfite, sodium phospho-aluminate, sodium silicate, sodium sorbate, sodium tripolyphosphate, sorbitol, soy protein (isolated), starch (acid modified, pregelatinized and unmodified), talc, vanillin, zinc hydrosulfite and zinc sulfate.

Cleaning Substrate

The cleaning composition may be part of a cleaning substrate. A wide variety of materials can be used as the cleaning substrate. The substrate should have sufficient wet strength, abrasivity, loft and porosity. Examples of suitable substrates include, nonwoven substrates, wovens substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

EXAMPLES

The compositions are simple, natural, high performance cleaning formulations with a minimum of essential natural ingredients. Competitive cleaners are either natural and inferior in performance or contain additional ingredients that make them non-natural, such as synthetic components. Because preservatives, dyes and colorants are used in such small amounts, these may be synthetic and the entire composition may still be characterized as natural. Preferably, the compositions contain only natural preservatives, dyes, and colorants, if any.

Table I illustrates all purpose cleaners of the invention. Table II illustrates glass cleaners of the invention. Table III illustrates additional cleaning compositions of the invention. Table IV shows that the compositions of the invention give equivalent performance to commercial non-natural, or synthetic cleaning compositions, and superior performance to commercial natural cleaning compositions. Table V illustrates additional cleaning compositions of the invention. Table VI illustrates cleaning compositions in the form of a lotion pre-loaded onto a wipe substrate made of natural biodegradable fibers (cotton, lyocell, etc.).

TABLE I

| All Purpose Cleaner | A | B | C | D | E | F |
|---|---|---|---|---|---|---|
| Glucopon ® 425N[1] | 2.24 | 3.00 | 1.00 | 5.00 | 1.50 | 3.00 |
| Ethanol | 1.16 | 3.00 | 0.50 | 5.00 | 1.50 | 1.50 |
| Glycerol | 0.22 | 0.30 | 0.10 | 1.00 | 0.50 | 0.30 |
| Lemon oil | 0.22 | 0.30 | 0.10 | 0.40 | | 0.20 |
| Essential oil w D-Limonene | | | | | 0.25 | |
| Preservative and Dye | 0.005 | None | 0.002 | 0.001 | 0.01 | 0.005 |
| Sodium Carbonate | | | | 0.15 | 0.10 | |
| Water | balance | balance | balance | balance | Balance | balance |

[1]Coco glucoside from Cognis.

TABLE II

| Glass Cleaner | G | H | I | J | K | L |
|---|---|---|---|---|---|---|
| Glucopon ® 425N | 0.60 | 1.50 | 0.30 | 0.50 | 0.50 | 1.00 |
| Ethanol | 2.00 | 3.00 | 1.50 | 0.50 | 1.00 | 2.00 |
| Glycerol | 0.11 | 0.20 | 0.05 | 0.05 | 0.10 | 0.20 |
| Lemon oil | | 0.20 | 0.05 | 0.05 | | |
| Essential oil w D-Limonene | 0.05 | | | | 0.10 | 0.15 |
| Preservative and Dye | 0.005 | 0.005 | 0.005 | 0.005 | 0.005 | 0.005 |
| Sodium Carbonate | 0.07 | 0.20 | 0.05 | 0.15 | | 0.15 |
| Water | balance | balance | balance | balance | Balance | balance |

TABLE III

| All Purpose Cleaner | M | N | O | P |
|---|---|---|---|---|
| Glucopon ® 215[1] | 2.00 | | | 2.00 |
| Glucopon ® 225[2] | | 1.50 | | |
| Glucopon ® 325[3] | | | 0.50 | |
| Glucopon ® 600[4] | | | | |
| Ethanol | 1.00 | 1.00 | 1.00 | 2.00 |
| Glycerol | 0.20 | 0.20 | 0.10 | 0.15 |
| Lemon oil | | | 0.10 | 0.20 |
| D-Limonene | | 0.15 | | |
| Essential oil with d-limonene | 0.20 | | | |
| Preservative and Dye/Colorant | 0.005 | 0.005 | 0.005 | 0.005 |
| Sodium Bicarbonate | 0.50 | | | |
| Sodium Hydroxide | | 0.05 | | 0.05 |

TABLE III-continued

| All Purpose Cleaner | M | N | O | P |
|---|---|---|---|---|
| Sodium Silicate | | | 0.05 | 0.05 |
| Water | balance | balance | balance | Balance |

[1]Capryl glucoside from Cognis.
[2]Decyl glucoside from Cognis.
[3]C9-C11 glucoside from Cognis.
[4]Lauryl glucoside from Cognis.

TABLE IV

| Cleaner | ASTM Bathroom | Filming Mirrors | Streaking Mirrors |
|---|---|---|---|
| Formula A | Basis | | |
| Lysol ® Antibacterial Spray | equal | | |
| Seventh Generation ® Natural Citrus Cleaner and Degreaser | less | | |
| Method ® All Purpose Surface Cleaner | less | | |
| Formula G | | Basis | Basis |
| Windex Vinegar Multisurface | | Equal | Equal |
| Seventh Generation ® Free and Clear Glass and Surface Cleaner | | less | Equal |
| Method ® Window Wash Glass and Surface Cleaner | | equal | Less |

TABLE V

| Glass Cleaner Components | Q | R | S | T |
|---|---|---|---|---|
| Ethanol | 2.0 | 2.5 | 2.5 | 2.5 |
| Glucopon ® 425 | 0.60 | 0.30 | 0.10 | 0.20 |
| Glycerine | 0.11 | 0.11 | 0.00 | 0.11 |
| Sodium Carbonate | 0.07 | 0.00 | 0.00 | 0.00 |
| Colloidal Silica (i.e. Bindzil 30/360) | 0.00 | 0.80 | 0.80 | 0.80 |
| Fragrance | 0.05 | 0.05 | 0.05 | 0.00 |
| Deionized Water | 97.2 | 96.2 | 96.6 | 96.4 |

TABLE VI

| Cleaner Components | T | U | V |
|---|---|---|---|
| Ethanol | 3.947 | 3.947 | 3.947 |
| Glucopon ® 225 DK (APG) | 0.857 | 0.000 | 0.000 |
| Alkadet 35 (APG) | 0.000 | 0.160 | 0.080 |
| SL 10 (APG) | 0.000 | 0.317 | 0.000 |
| Glucopon ® 425N (APG) | 0.000 | 0.000 | 0.220 |
| Glycerine | 0.111 | 0.111 | 0.111 |
| Sodium Carbonate | 0.110 | 0.110 | 0.110 |
| Colloidal Silica | 1.000 | 1.000 | 1.000 |
| Oleic Acid | 0.050 | 0.050 | 0.050 |
| Fragrance | 0.150 | 0.150 | 0.150 |
| Deionized Water | 93.775 | 94.155 | 94.332 |
| pH of Lotion | 10.0 | 10.0 | 10.0 |
| pH of lotion wipe | 7.0-8.0 | 7.0-8.0 | 7.0-8.0 |
| Colloidal Silica Particle Size | 8 nm | 8 nm | 8 nm |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A hard surface cleaning composition consisting essentially of:
a. 0.1 to 5% alkyl polyglucoside;
b. 0.5 to 5% ethanol;
c. 0.1 to 3% colloidal silica;
d. water; and
e. optionally dyes, builders, fatty acids, fragrances, colorants, glycerol and preservatives.

2. The composition of claim 1, wherein the composition comprises 0.1 to 2.0% alkyl polyglucoside.

3. The composition of claim 1, wherein the composition comprises 0.1 to 2.0% colloidal silica.

4. The composition of claim 1, wherein the composition is loaded onto a substrate.

5. The composition of claim 1, wherein the colloidal silica has particles with diameters of about 5 nm to about 50 nm.

6. The composition of claim 1, wherein the composition has a pH of between about 9 and about 11.

7. A hard surface cleaning composition consisting essentially of:
a. 0.1 to 5% alkyl polyglucoside;
b. 0.5 to 5% ethanol;
c. 0.05 to 5% glycerol;
d. 0.1 to 3% colloidal silica;
e. water; and
f. optionally dyes, builders, fatty acids, fragrances, colorants, and preservatives.

8. The composition of claim 7, wherein the composition comprises 0.1 to 2.0% colloidal silica.

9. The composition of claim 7, wherein the colloidal silica has particles with diameters of about 5 nm to about 50 nm.

10. The composition of claim 7, wherein the composition has a pH greater than 7.5.

11. The composition of claim 7, wherein the composition is loaded onto a substrate.

12. A hard surface cleaning composition consisting essentially of:
a. 0.1 to 5% alkyl polyglucoside;
b. 0.5 to 5% ethanol;
c. 0.01 to 1% fragrance;
d. 0.1 to 3% colloidal silica;
e. water; and
f. optionally dyes, builders, colorants, fatty acids, and preservatives.

13. The composition of claim 12, wherein the composition has a pH between about 9 to about 11.

14. The composition of claim 12, wherein the composition has a pH greater than about 7.5.

15. The composition of claim 12, wherein the colloidal silica has particles with diameters of about 1 nm to about 100 nm.

16. The composition of claim 12, wherein the fragrance comprises d-limonene.

17. The composition of claim 12, wherein the composition is loaded onto a substrate.

18. A hard surface cleaning composition consisting essentially of:
a. 0.1 to 5% alkyl polyglucoside;
b. 0.5 to 5% ethanol;
c. 0.05 to 5% glycerol;
d. 0.01 to 1% fragrance;
e. 0.1 to 3% colloidal silica;
f. water; and g. optionally dyes, builders, colorants, fatty acids and preservatives.

19. The composition of claim 18, wherein the fragrance is selected from the group consisting of d-limonene and citrus.

20. The composition of claim 18, wherein the colloidal silica has a particle diameter of about 5 nm and about 50 nm.

* * * * *